US006413337B2

(12) United States Patent
Sciarrino et al.

(10) Patent No.: US 6,413,337 B2
(45) Date of Patent: Jul. 2, 2002

(54) NATURAL STONE TILE EDGING

(76) Inventors: Pete A. Sciarrino; Kathleen M. Sciarrino, both of 2635 Kildare Way, El Cajon, CA (US) 92020

( * ) Notice: Subject to any disclaimer, the term of this patent is extended or adjusted under 35 U.S.C. 154(b) by 0 days.

(21) Appl. No.: 09/902,367

(22) Filed: Jul. 9, 2001

Related U.S. Application Data

(62) Division of application No. 09/325,295, filed on Jun. 3, 1999, now Pat. No. 6,258,190.

(51) Int. Cl.[7] ..... A47B 13/08; A47B 96/18; B32B 1/04

(52) U.S. Cl. ..... 156/71; 52/287.1; 52/782.2; 312/140.3; 312/140.4; 108/27; 156/182

(58) Field of Search ..... 156/71, 182; 52/287.1, 52/782.2; 312/140.3, 140.4; 108/27

(56) References Cited

U.S. PATENT DOCUMENTS 5,310,435 A * 5/1994 Kelly ..... 156/182

* cited by examiner

*Primary Examiner*—Sam Chuan Yao
(74) *Attorney, Agent, or Firm*—Brown, Martin, Haller & McClain LLP

(57) ABSTRACT

A natural stone edging tile having a top portion and a generally perpendicular facing portion can be mounted on the forward edge of a countertop substrate and has a portion extending rearward of the forward edge that is approximately half as thick as the forward edge and the same thickness as conventional stone tiles that can be mounted rearward of the edging tile. The conventional tiles have a thickness that is approximately half as thick as a typical stone slab countertop, but to a person viewing the countertop, the entire appears to have the substantial thickness of a typical slab countertop because the forward edge of the edging tile has such a thickness.

11 Claims, 4 Drawing Sheets

NATURAL STONE TILE EDGING

This application is a divisional of application Ser. No. 09/325,295 filed Jun. 3, 1999 (now U.S. Pat. No. 6,258,190).

BACKGROUND OF THE INVENTION

1. Field of the Invention

The present invention relates generally to tiles for countertops and the like and, more specifically, to tile structures and methods for making a tiled edge on a countertop or the like.

2. Description of the Related Art

Kitchen countertops, tables, cabinets, bars and other structures can be covered with tile to provide an attractive and durable finish. Ceramic tile is most commonly used. Ceramic tiles are bonded to the surface of, for example, a plywood kitchen counter substrate with a suitable mastic or cement-based adhesive. The space between tiles is filled with a suitable grout. Specially shaped edging tiles having an angled or L-shaped cross-sectional shape are mounted in this manner to the edges of the substrate to provide an attractive appearance. The edging tiles thus cover both a portion of the plywood substrate and a narrow strip of the cabinetry immediately below the substrate. The corner of an edging tile is typically radiused in some manner. For example, it may have a bullnose shape, or it may have what is known in the architectural design field as an ogee shape, which is a type of compound curve having both convex and concave portions. Because a ceramic tile is made by molding a clay-like material and firing it in a kiln, any desired shape or profile may be readily produced by providing a suitably shaped mold.

Countertops and the like can also be made of granite, marble and other natural stone. The beauty of such a countertop owes to the unique patterns and colors inherent in natural stone; no two pieces of stone are exactly alike in appearance, even if quarried from the same geographic area. A common method of making a natural stone countertop is to cut a stone slab to the desired countertop size (which, in the United States, has a de facto standard width of 24 inches), grind the forward edge of the slab to a desired profile shape such as a bullnose or bevel, polish the surface of the slab, and bond it to the substrate with a suitable adhesive. A de facto standard thickness of natural stone countertop slabs is two centimeters (approximately ¾ inches). The slab may have a cutout opening for a kitchen sink. The slab may have a width slightly greater than the width of the substrate so that it overhangs the forward edge of the substrate. A strip-like piece or slab of facing stone having an appearance matching that of the countertop slab is typically mounted in a similar manner to the cabinetry edge immediately below the overhanging forward edge of the countertop slab to provide an attractive face. If, as is typical in a kitchen installation, a single slab is insufficient to cover the entire substrate, pieces that are to be mounted adjacent one another are selected to match one another in appearance. Typically, to ensure matching, the pieces are cut from the same block of quarried stone.

An increasingly popular method of making a natural stone countertop is to use tiles made of natural stone tiles. Stone tiles are laid in essentially the same manner as any tile. That is, tiles are adhesively mounted on a substrate and the spaces between them filled with grout. The tiles mounted at the forward edge of the countertop substrate overhang the edge of the substrate slightly. A facing tile can be mounted to the cabinetry immediately below the overhanging portion of the edging tile. The forward edge of the countertop can then be ground and polished to provide a bullnose or other desired profile.

The primary advantage is that a natural stone tile countertop is substantially more economical in material and labor costs than a natural stone slab countertop. Natural stone tiles are commercially available in de facto standard sizes, such as 12 inches square. Labor costs to install a stone tile countertop are lower than those to install a stone slab countertop because a slab must be cut, shaped, polished, matched with a facing piece, and carefully laid upon the substrate, all of which require the assistance of a number of persons as well as special machines and tools because the slab is heavy and unwieldy. In contrast, stone tiles can be mass-produced and sold in boxes of any desired quantity in essentially the same manner as any tile. Though more costly than ceramic tiles because granite and other stone is in economic terms a scarce natural resource in comparison to ceramic materials, because they must be cut from the quarried stone and polished, and because they must be cut in a manner that ensures they match in appearance, a quantity of stone tiles sufficient to cover a given area are nonetheless substantially more economical than a stone slab of equal area. Importantly, material costs for such a quantity of stone tiles are also less than material costs for a slab of equal area because stone tiles typically have a thickness that is substantially less (often about one-half) than that of stone slabs. Commercially available natural stone tiles are typically only ⅜ inches in thickness, in contrast to natural stone slabs, which are typically ¾ inches in thickness. Slabs have this thickness because a thinner slab is more likely to break or crack under the stresses of the various cutting, shaping, polishing and installation steps. Because a 12 inch square tile is relatively small in area in comparison to a slab, it can be relatively thin yet have sufficient structural integrity to prevent breakage during manufacturing, handling and installation.

Many consider a slab countertop to be more attractive than a tile countertop, not only because grouted joints may have disadvantages but also because the thickness of a slab conveys a sense of mass and permanence, which many find appealing and elegant. One can readily judge the thickness of stone countertops of the types described above by its forward edge.

It would be desirable to provide a natural stone countertop having a structure that makes it more attractive than those known in the art yet is more economical than a slab countertop. These problems and deficiencies are clearly felt in the art and are solved by the present invention in the manner described below.

SUMMARY OF THE INVENTION

The present invention relates to a natural stone edging tile. The edging tile has a top portion and a facing portion so that it can be mounted on the forward edge of a countertop substrate or other structure. Conventional natural stone tiles can be mounted on the substrate rearward of the edging tiles in the conventional manner. As such, the conventional tiles have a thickness that is substantially less than the thickness of a typical stone slab countertop. Nevertheless, to a person viewing the countertop of the present invention, the entire countertop appears to have the substantial thickness of a typical slab countertop because the forward edge of the edging tile has such a thickness.

For purposes of the this patent specification, the term "countertop" includes within its scope not only kitchen, bathroom and other countertops, but also tables, cabinets, bars and other structures that are known in the art to be coverable with tile. The top portion has a rearward edge and an at least partially radiused forward edge. For purposes of this patent specification, the term "radiused" includes within its scope not only that shape which is commonly known to architects and designers as a radius edge, but also other shapes at least a portion of which are radiused or curved, such as the shapes known as bullnose, double-bullnose, ogee and beveled.

As described above, the forward edge has a thickness comparable to that of a typical stone slab countertop. Nevertheless, between the forward edge and the rearward edge, the edging tile has a thickness that is no greater than about half the thickness of the forward edge. For example, in an illustrative embodiment of the invention, the forward edge has a thickness of ¾ inches (approximately two centimeters), and the portion extending between the forward and rearward edges has a thickness of ⅜ inches (approximately one centimeter). The upper edge of the facing portion is bonded to the lower surface of the top portion adjacent to the forward edge. At least a portion of the facing portion is perpendicular to the upper surface of the top portion, thus providing the generally L-shaped structure that is characteristic of an edging tile. Although adhesive bonding is preferred, the term "bonding" as used in this patent specification includes within its scope all known methods for attaching stone pieces to one another.

A countertop made of conventional natural stone tiles in combination with the novel edging tiles of the present invention has an apparent thickness comparable to that of a stone slab countertop, yet is significantly more economical in material costs because the actual thickness of the conventional tiles is less than this apparent thickness. The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF PREFERRED EMBODIMENTS

Figure 1:
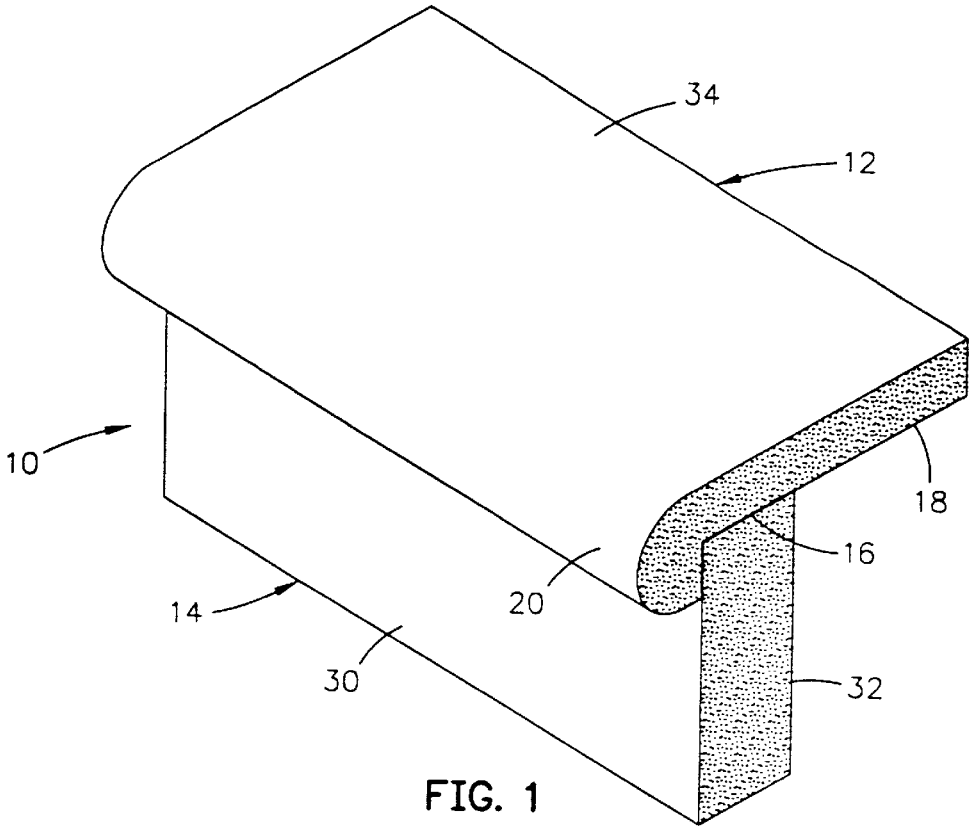
FIG. 1 is a perspective view of an edging tile of the present invention.
Figure 2:
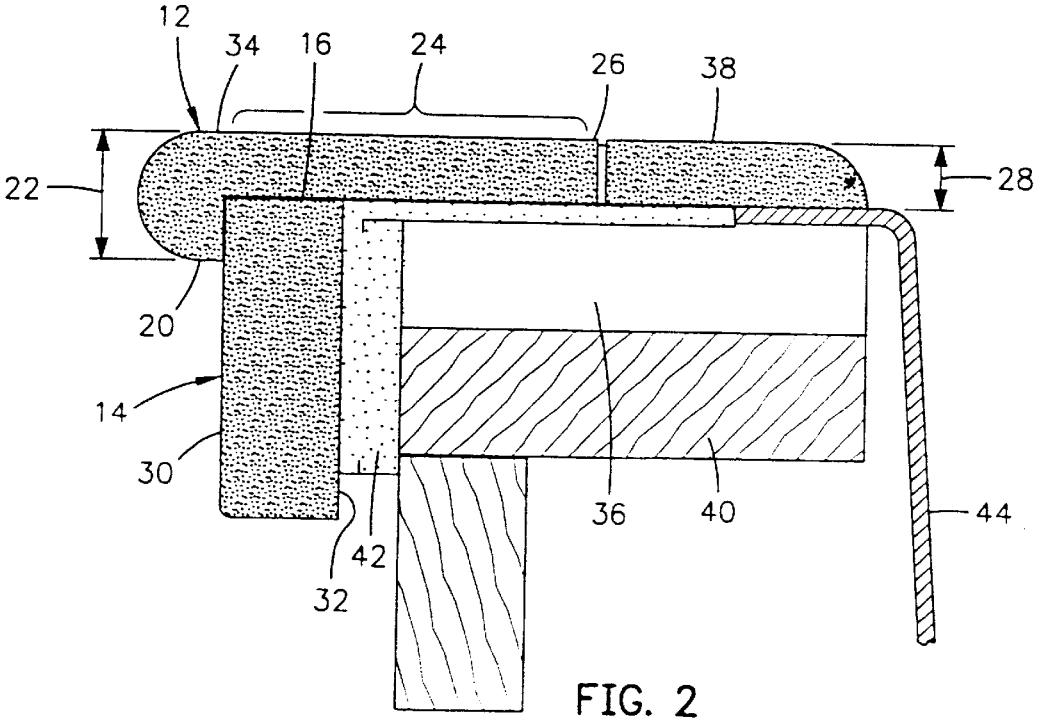
FIG. 2 is a cross-sectional view of the edging tile of FIG. 1 in a typical kitchen countertop installation.

As illustrated in FIGS. 1 and 2, an edging tile 10 is made of natural stone, such as granite. Tile 10 includes a top portion 12 and a facing portion 14. The upper edge 16 of facing portion 14 is adhesively bonded to the lower surface 18 of top portion 12 adjacent to the forward edge 20 of top portion 12. A suitable adhesive is epoxy, such as that sold under the brand name TENAX. Portions 12 and 14 are preferably cut from the same block of quarried stone so that they closely match each other in appearance. Forward edge 20 has a double-bullnose or rounded profile. Forward edge 20 has a thickness 22 of ¾ inches (approximately two centimeters), and the portion 24 extending between forward edge 20 and the rearward edge 26 has a thickness 28 of ⅜ inches (approximately one centimeter). The outer surface 30 (and, for that matter, the inner surface 32) of facing portion 14 is perpendicular to the upper surface 34 of top portion 12, thus providing the generally L-shaped structure that is characteristic of an edging tile.

As illustrated in FIG. 2, when tile 10 is mounted on the forward edge of a kitchen countertop substrate 36 the entire countertop appears to have the substantial thickness (typically ¾ inches) of a typical natural stone slab-construction countertop because forward edge 20 of tile has such a thickness 22. Other natural stone tiles 38 that are similar to conventional, flat or plate-like stone tiles can be mounted on substrate 36 rearward of tile 10 in the conventional manner. The space between tiles 10 and 38 is grouted in the conventional manner. Tiles 38 have the same thickness 28 as portion 24 of tile 10. Thickness 28 is substantially less than the thickness of a typical stone slab countertop, making the resulting countertop as a whole quite economical in material costs in comparison to a stone slab countertop. Although thickness 22 is most preferably ¾ inches to conform to the de facto standard thickness of stone slab countertops in at least the United States and Europe, and thickness 28 is preferably ⅜ inches, any thicknesses that both achieve the desired visual effect and provide suitably economical countertop construction would be suitable. An aspect of the invention is the critical recognition that these competing goals are achieved if thickness 28 is no greater than about one-half thickness 28.

The remaining aspects of the countertop construction is conventional. That is, substrate 36, which is a conventional tile mortar, is laid on the top of the kitchen cabinetry 40, which is typically plywood. A thinset concrete or similar tile adhesive 42 is laid over substrate 36 in the conventional manner. A kitchen sink 44 can be mounted in an opening in cabinetry 40, and can be bordered by other tiles 38. Nevertheless, edging tiles of the present invention can be used to border a sink or other structure. To enhance such installations, in other embodiments the rearward edge of the edging tile may have a half-bullnose shape much like the half-bullnose shape of tile 38 that borders sink 44. Indeed, as indicated below with respect to other embodiments of the edging tile, the forward, rearward and other edges may have any suitable shape.

Figure 3:
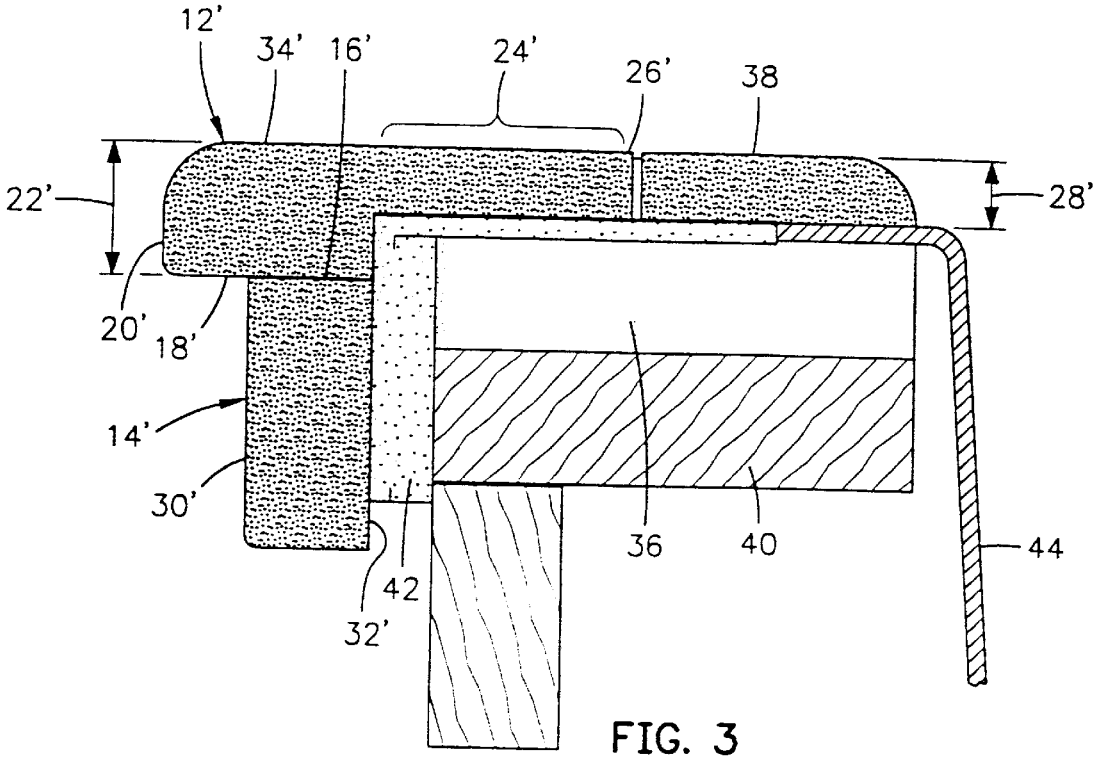
FIG. 3 is a cross-sectional view of an alternative edging tile in a typical kitchen countertop installation.

As illustrated in FIG. 3, the forward edge 20' of an alternative edging tile 10' has a bullnose profile but is otherwise similar in construction to tile 10 described above. Thus, it has a top portion 12' and a facing portion 14', with the upper edge 16' of facing portion 14' adhesively bonded to the lower surface 18' of top portion 12' adjacent to forward edge 20'. Forward edge 20' has a thickness 22' of ¾ inches (approximately two centimeters), and the portion 24' extending between forward edge 20' and the rearward edge 26' has a thickness 28' of ⅜ inches (approximately one centimeter). The surfaces 30' and 32' of facing portion 14' are perpendicular to the upper surface 34' of top portion 12'.

Figure 4:
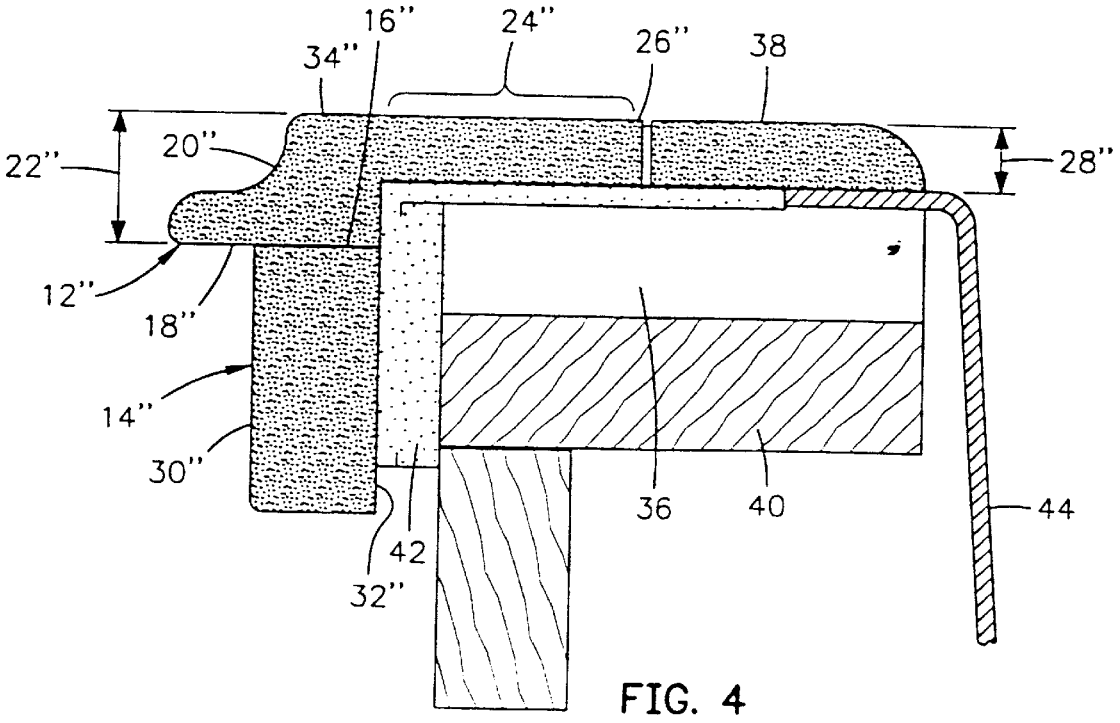
FIG. 4 is a cross-sectional view of another alternative edging tile in a typical kitchen countertop installation.

As illustrated in FIG. 4, the forward edge 20" of another alternative edging tile 10" has an ogee or convex-concave profile but is otherwise similar in construction to tiles 10 and 10' described above. Thus, it has a top portion 12" and a facing portion 14", with the upper edge 16" of facing portion 14" adhesively bonded to the lower surface 18" of top portion 12" adjacent to forward edge 20". Forward edge 20" has a thickness 22" of ¾ inches (approximately two centimeters), and the portion 24" extending between forward edge 20" and the rearward edge 26" has a thickness 28" of ⅜ inches (approximately one centimeter). The surfaces 30" and 32" of facing portion 14" are perpendicular to the upper surface 34" of top portion 12".

Figure 5:
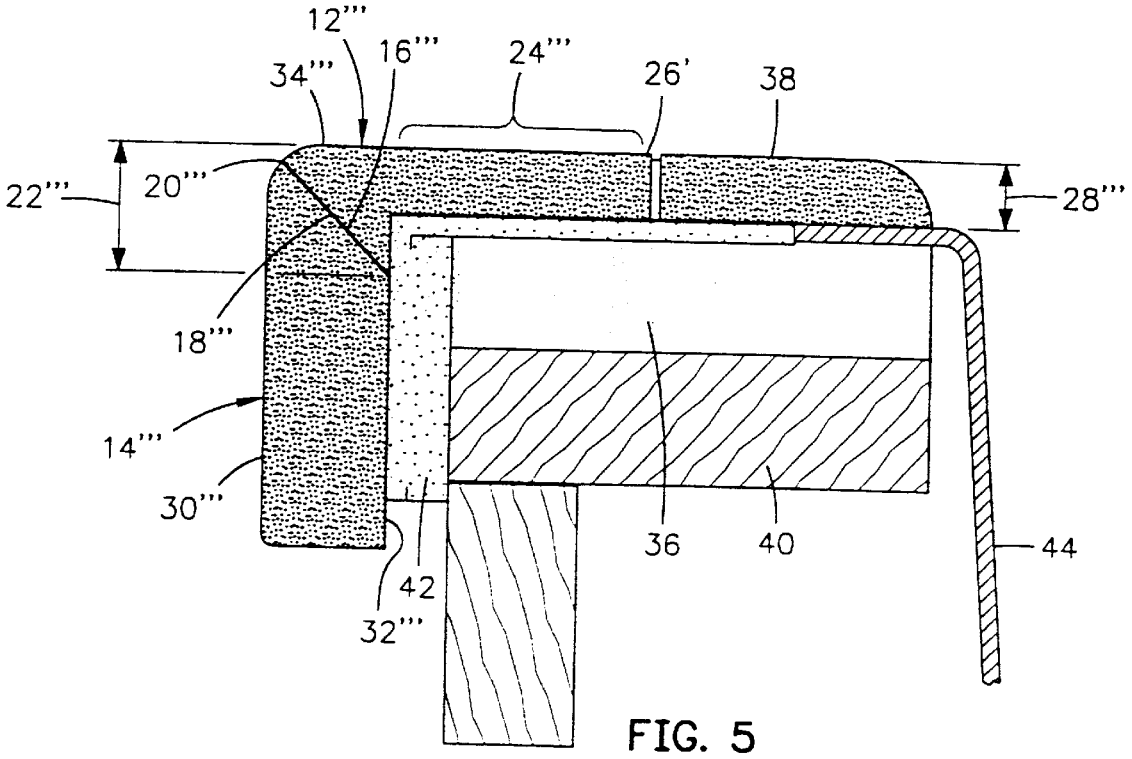
FIG. 5 is a cross-sectional view of still another alternative edging tile in a typical kitchen countertop installation.

As illustrated in FIG. 5, the forward edge 20'" of still another alternative edging tile 10'" is mitered at a 45° angle with respect to the upper surface 34'" of top portion 12'". Nevertheless, as in the above-described embodiments, it has a top portion 12" and a facing portion 14'", with the upper edge 16'" of facing portion 14'" adhesively bonded to the lower surface 18'" of top portion 12" adjacent to forward edge 20'". Upper edge 16'" of facing portion 14'" is mitered at a corresponding 45° angle. Forward edge 20'" has a thickness 22'" of ¾ inches (approximately two centimeters), and the portion 24'" extending between forward edge 20'" and the rearward edge 26'" has a thickness 28'" of ⅜ inches (approximately one centimeter). The surfaces 30'" and 32'" of facing portion 14'" are perpendicular to upper surface 34'" of top portion 12".

Figure 6:
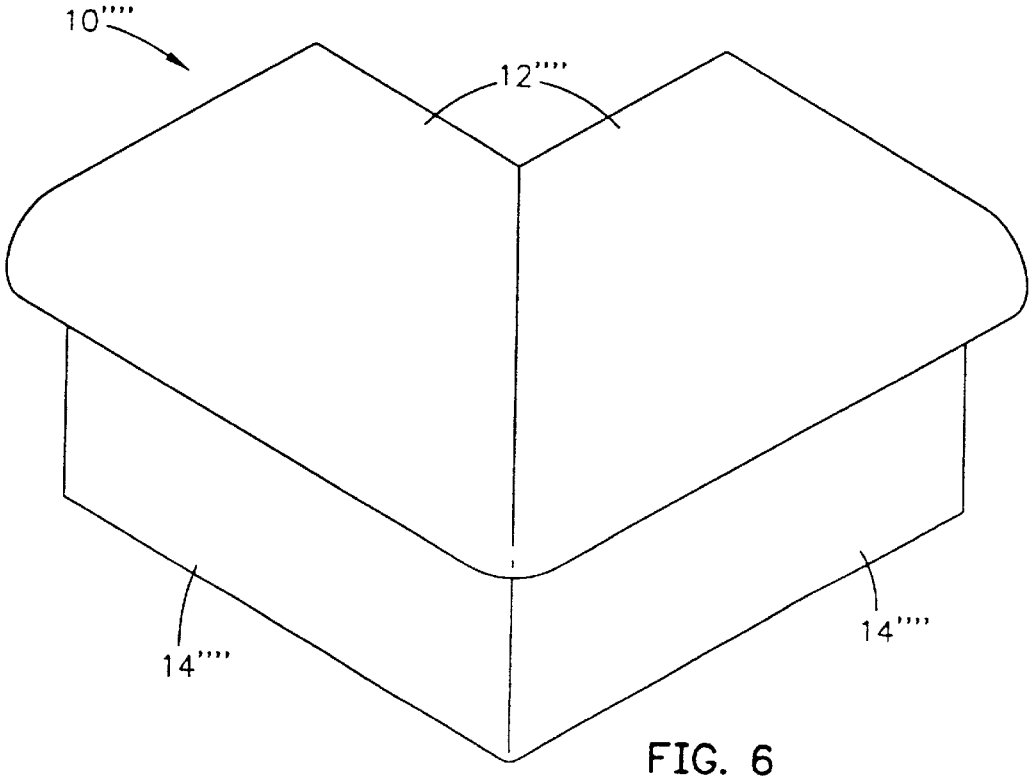
FIG. 6 is a perspective view of a further alternative edging tile.

An edging tile of the present invention may have any suitable shape and size provided that it is sufficiently small that it can be handled and installed in the manner of a conventional tile. Thus, it preferably has no dimension greater than about 12 inches (30.5 cm). An example of a tile 10"" having another suitable shape is illustrated in FIG. 6. Tile 10"" is similar in construction to tile 10, described above, but comprises two sections joined together at a 45° mitered joint. Like tile 10, it has a top portion 12"" and a facing portion 14"".

Figure 7:
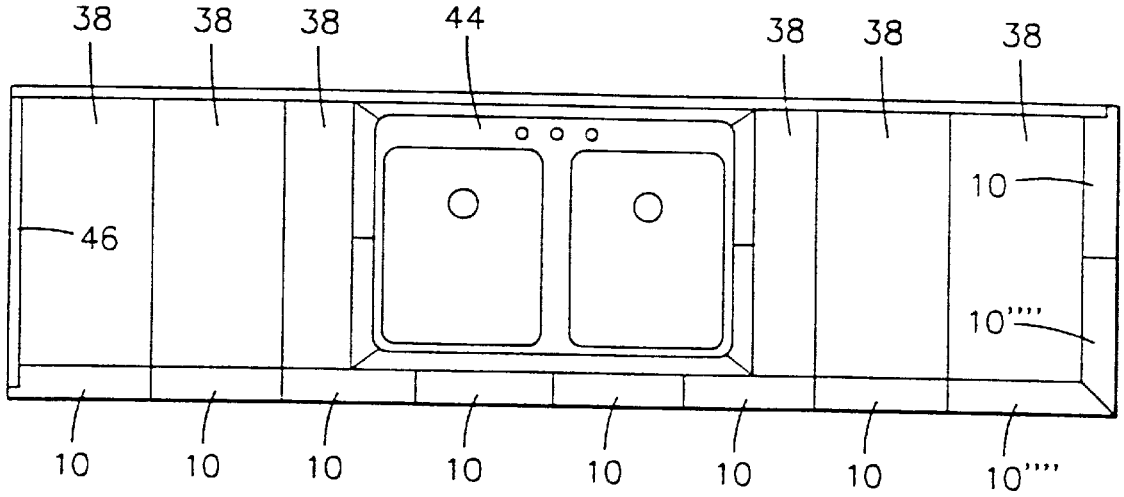
FIG. 7 is a top plan view of a typical kitchen countertop, showing tiles of the present invention installed.

As illustrated in FIG. 7, an entire kitchen countertop can be made by laying a number of tiles 10 along the edges, laying tiles 10"" at the corners, and laying tiles 38 rearward of them. Tiles 38 preferably have dimensions of 12 inches in width by 24 inches in depth. As described above, tiles 38 may border sink 44. Backsplashes 46 made of natural stone that matches that of the tiles may be included in the conventional manner. To an observer, the entire countertop has an apparent thickness comparable to that of a stone slab countertop. Nevertheless, the countertop is significantly more economical in material costs than a stone slab countertop because tiles 38 are much thinner than such a stone slab countertop and are thus relatively more economical.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A stone edging tile, comprising:

a top member made of natural stone and having a lower surface and a polished upper surface, said top member having a rearward edge, a planar plate portion, and an at least partially radiused forward edge, said forward edge has a thickness, the planar plate portion of said top member extends between said forward edge and said rearward edge and has a uniform thickness no greater than about half said thickness of said forward edge; and a facing member made of natural stone and having an upper edge bonded to said lower surface of said top member adjacent said forward edge and having a planar plate portion perpendicular to said upper surface of said top member.

2. A stone edging tile as claimed in claim 1, wherein said upper edge of said facing member is bonded to said plate portion of said top member.

3. A stone edging tile as claimed in claim 2, wherein said forward edge has a double-bullnose shape.

4. A stone edging tile as claimed in claim 1, wherein said upper edge of said facing member is bonded to said forward edge.

5. A stone edging tile as claimed in claim 4, wherein said forward edge has a single bullnose shape.

6. A stone edging tile as claimed in claim 4, wherein said forward edge is radiused both convexly and concavely.

7. A stone edging tile as claimed in claim 4, wherein:

said lower surface of said top member at said forward edge is mitered or inclined at a non-zero angle with respect to said upper surface; and said upper edge of said facing member is mitered or inclined at a non-zero angle complementary to said non-zero angle at which said lower surface of said top member at said forward edge is inclined.

8. A stone edging tile as claimed in claim 7, wherein said non-zero angle at which said upper edge of said facing member is inclined is 45 degrees.

9. A method for using a stone edging tile, said tile comprising a top member made of natural stone and having a lower surface and a polished upper surface, said top member having a rearward edge, a planar plate portion, and an at least partially radiused forward edge, said forward edge has a thickness, the planar plate portion of said top member extends between said forward edge and said rearward edge and has a uniform thickness no greater than about half said thickness of said forward edge, said tile further comprising a facing member made of natural stone and having an upper edge bonded to said lower surface of said top member adjacent said forward edge and having a planar plate portion perpendicular to said upper surface of said top member, the method comprising the step of:

bonding said stone edging tile to a countertop by bonding said lower surface of said top member to a top surface of said countertop and bonding said facing member to a front surface of said countertop perpendicular to said top surface of said countertop.

10. A method as claimed in claim 9, further comprising the step of bonding to said countertop adjacent said rearward edge an additional tile made of natural stone and having a uniform thickness equal to the thickness of said plate portion of said top member.

11. A method as claimed in claim 9, further comprising the steps of:

repeating said step of bonding said stone edging tile to a countertop by bonding a plurality of stone edging tiles adjacent to one another along an edge of said countertop; and repeating said step of bonding to said countertop adjacent said rearward edge an additional tile made of natural stone until at least one said additional tile is bonded adjacent said rearward edge of each said stone edging tile.

* * * * *